US006159341A

United States Patent [19]

Egelhof et al.

[11] Patent Number: 6,159,341

[45] Date of Patent: Dec. 12, 2000

[54] WIRE PART FOR FORMING A MULTI-PLY FIBER WEB

[75] Inventors: Dieter Egelhof, Heidenheim; Alfred Bubik, Ravensburg; Peter Mirsberger, Baienfurt, all of Germany; Otto L. Heissenberger, West Chester; Frank Herzog, Middletown, both of Ohio; Wolf Dieter Baumann, St. Pölten, Austria; Josef Bachler, Ulmerfeld-Hausmening, Austria; Günter Halmschlager, Rohrendorf, Austria; Frank Stelzhammer, Böheimkirchen, Austria; Günther Mohrhardt, Sao Paolo, Brazil

[73] Assignee: Voith Sulzer Papiermaschinen GmbH, Germany

[21] Appl. No.: 08/987,981

[22] Filed: Dec. 10, 1997

[30] Foreign Application Priority Data

Dec. 11, 1996 [DE] Germany ..... 196 51 493

[51] Int. Cl.[7] ..... D21F 1/00

[52] U.S. Cl. ..... 162/303; 162/132; 162/304

[58] Field of Search ..... 162/132, 303, 162/304

[56] References Cited

U.S. PATENT DOCUMENTS

| | | | |
|---|---|---|---|
| 3,985,612 | 10/1976 | Watanabe | 162/203 |
| 4,154,645 | 5/1979 | Kankaanpää | 162/133 |
| 5,445,713 | 8/1995 | Kunihisa et al. | 162/304 |
| 5,584,967 | 12/1996 | Grossmann et al. | 162/304 |
| 5,635,033 | 6/1997 | Grossmann et al. | 162/304 |
| 5,788,816 | 8/1998 | Steckenreuter et al. | 162/304 |

FOREIGN PATENT DOCUMENTS

| | | |
|---|---|---|
| 930580 | 7/1973 | Canada . |
| 2059962 | 6/1971 | Germany . |
| 29513969 | 12/1995 | Germany . |
| 9206242 | 4/1992 | WIPO . |

OTHER PUBLICATIONS

DuoFormer Top—a new Former for the Production of Top Plies of Packaging Papers by G. Halmschlager, TAPP 97 Nashville, Mittwoch, Oct. 8, 1997.

Weitkämper, K.: 1. Blattbildungsbereich. In: Das Papier, 1991, 45. Jg., H. 10A, S.V97–V106.

Schmidt. S., Liuttu. P.: Former Für die Herstellung mehrlagiger Bahnen. In: Wochenblatt für Papierfabrikation 23/24, 1977, S. 975–978, 980; Abb. 5.

*Primary Examiner*—Christopher A. Fiorilla
*Attorney, Agent, or Firm*—Ostrolenk, Faber, Gerb & Soffen, LLP

[57] ABSTRACT

A wire section for forming a multi-ply fiber web. The wire section includes a first belt which advances a first fiber ply toward a couch roll defining a combining section. A twin-wire zone of the wire section includes first and second wires between which a second fiber ply is initially formed in a gap former. The second wire separates from the first wire and then the first wire supporting the second fiber ply meets the first belt supporting the first fiber ply at the couch roll of the combining section to form the multi-ply fiber web. The twin-wire part is arranged upstream of the combining section along the running direction of the first belt. The second fiber ply runs on the first wire into the combining section at an angle less than 90° with respect to the belt entering the combining section. The path of the wires from the forming roll to the combining section is disclosed. A suction box or arrangement holds the second fiber ply to the first wire when the first and second wires separate. Dewatering foils press on the wires moving through the twin-wire zone.

26 Claims, 2 Drawing Sheets

WIRE PART FOR FORMING A MULTI-PLY FIBER WEB

BACKGROUND OF THE INVENTION

The present invention relates to a wire section of a fiber web forming machine, particularly a paper making machine for forming a multi-ply fiber web, particularly a paper web. The wire section includes a wire section belt of a paper machine on which a first fiber ply is formed. It includes a twin-wire part of the wire section designed as a gap former and having a first and a second wire in which part a second fiber ply is formed. The two wires wrap around a forming roll at the beginning of the twin wire part. It further includes a combining section, in which the first and the second fiber plies are combined, for forming the multi-ply fiber web.

The invention further relates to a process for forming a multi-ply fiber web, including the steps of forming a first fiber ply, forming a second fiber ply, and then combining the first fiber ply, which is running in on a belt, and the second fiber ply, which is running in on a first wire, in a combining section.

Such a wire section and a process of this type for forming a multi-ply fiber web are disclosed in DE 44 02 274 A1, equivalent to U.S. Pat. No. 5,584,967. This known wire section comprises a conventional Fourdrinier unit for forming a first fiber ply on a belt in the form of a horizontal wire. A second fiber ply is formed by a twin-wire part arranged above the first belt. The first and second plies are couched together, forming a multi-ply fiber web, particularly a paper or board web. According to FIG. 5 of DE '274, the twin-wire part is designed as a gap former.

The twin-wire part for forming the second fiber ply has a headbox or flowbox, has an evacuated forming roll downstream of the headbox, has a so-called D part which typically dewaters the web through a wire by suction and also applies pressure pulses on the wire and has a second forming roll. The two wires of the twin-wire part are led approximately horizontally and counter to the running direction of the belt, between the first forming roll and the second forming roll.

In the outlet region of the second forming roll, the top wire is lifted off the second fiber ply, and the second fiber ply is led to the couch roll on the bottom wire, at an angle of about 80° to the first wire.

Another wire section for forming a multi-ply fiber web is disclosed in WO 92/01111. In this wire section too, a first fiber ply is brought up on a belt which is a wire belt that runs approximately horizontally. A twin-wire part for forming a second fiber ply is arranged above the belt. The twin-wire part for forming the second fiber ply has a headbox and a forming board arranged downstream of the headbox. The board has a multiplicity of forming foils, which form a convexly slightly curved running surface for the first and the second wires and which engage the wire to produce pressure pulses. A wiper is provided on the top side at the outlet of the forming board. The top wire is lifted off the second fiber web upstream of the entry region of a couch roll. The bottom wire wraps around the couch roll by about 120°. A guide roll is provided on the underside of the belt so that the belt and the first wire wrap around the couch roll by about 45°. In the wire section in WO 92/01111, dewatering of the second fiber ply takes place solely on account of the tensile stress of the wires acting on the forming board, by centrifugal forces and by the force of gravity.

It is not possible to achieve high running speeds using these known wire sections. In addition, the twin-wire part arranged above the Fourdrinier unit needs considerable space. It is particularly unfavorable that the twin-wire part is located above that part of the Fourdrinier unit in which the finally formed (but still moist) multi-ply fiber web runs, on the belt, in the direction toward the following treatment stations (e.g. wire suction roll, press section, etc.). The quality of the web is thereby impaired.

SUMMARY OF THE INVENTION

It is the object of the present invention to provide a wire section of a paper machine and a process for forming a multi-ply fiber web that is as compact as possible and a process for forming a multi-ply fiber web that is of as high a quality as possible at high speeds.

The invention concerns a wire section for forming a multi-ply fiber web.

The wire section includes a belt which advances a first fiber ply toward a couch roll defining a combining section. A twin wire part of the wire section includes first and second wires between which a second fiber ply is initially formed. The second wire separates from the first wire and then the first wire which is supporting the second fiber ply meets the belt supporting the first fiber ply at the couch roll of the combining section to form the multi-ply fiber web. The twin wire part is arranged upstream of the combining section along the running direction of the belt. The second fiber ply runs on the first wire into the combining section at an angle to the orientation of the belt entering and in the combining section, and particularly at an angle less than 90° with respect to the belt entering the combining section. A suction box or arrangement holds the second fiber ply to the first wire when the first and second wires separate.

The wire section mentioned at the beginning achieves this object by the inflow direction of the fiber suspension into the gap former substantially corresponding to the running direction of the belt and furthermore, by the twin-wire part being upstream of the combining section in the running direction of the belt and by the second fiber ply on the first wire of the twin wire part running into the combining section angle to the orientation of the belt entering and in the combining section, and particularly at an angle of less than 90° with respect to the belt.

The process mentioned at the beginning for forming a multi-ply fiber web achieves this object because the second fiber ply is formed at least predominantly in the running direction of the belt and in a region which lies upstream of the combining section in the running direction of the belt. A second reason why the object is achieved is and because the second fiber layer on the first wire runs into the combining section at an angle of less than 90° with respect to the belt.

By the measures described above particularly with reference to the angle of the second ply with respect to the belt orientation of the combining section, the belt as well as the first and the second wires in the web forming section run substantially in the same running direction. It is therefore not necessary for the running direction of the second fiber ply to be deflected so sharply as in prior art before being combined with the first fiber ply. This eliminates the risk of the web lifting off the wire on which the web is carried at a location in the region of the couch roll, particularly if a relatively large diameter couch roll is provided. The runability of the overall wire section is increased. Thus, the limitation of the speed that is necessary with known wire sections is avoided. The multi-ply fiber web can therefore be formed at much higher speeds than was possible previously.

In addition, the smaller deflection at a higher speed allows higher moisture content directly upstream of the combining section, which produces an improved ply bond strength.

Furthermore, as a result of the invention the second fiber ply is formed above the initial part of the Fourdrinier unit, that is, above, where the first fiber ply is located on the belt. This avoids the second ply being formed above the combined, multi-ply fiber web. The combined multi-ply fiber web is therefore not interfered with by the twin-wire part which forms the second fiber ply. Such interference, for example, may be by condensate droplets falling on the combined web. This improves the quality of the finished multi-ply web.

Finally, arranging the twin-wire part upstream of the combining section in the running direction of the belt provides more space for the arrangement of dewatering and suction elements in the initial part of the Fourdrinier unit, since the combining point can be located closer to a wire suction roll of the Fourdrinier unit, for example. This produces a particularly compact construction of the wire section according to the invention.

The belt for the first ply can be designed as a wire or as a felt.

Moreover, it has been shown that an entry angle range of less than 90° for the second ply with reference to the orientation of the belt at the combining section is particularly beneficial for achieving particularly high speeds and a compact construction. An entry angle range of between 60° and 80° is particularly preferred particularly in cooperation with the above-mentioned relative large diameter couch roll.

According to a further preferred embodiment, the twin-wire part may be a separate unit which is placed as a unit onto the Fourdrinier unit. This enables the twin-wire part of the wire section according to the invention to be used for retrofitting of existing wire sections.

The design of the twin-wire former as a gap former produces a very good transverse profile of the second fiber ply and also enables very quiet running, which may be summarized under the heading "very good stability". Further advantages of using a forming roll as the first forming element after the headbox reside in a particularly insensitive jet injection and in secure guidance not only of the inner wire but also of the outer wire, without the risk of "wire piping", which can cause longitudinal stripes in the finished paper. This risk exists when the first forming element is an only slightly curved forming board. There is a further advantage that, in spite of a relatively high consistency (about 1–1.5%), a finished paper web is produced which has very good "formation", i.e., with uniform fiber distribution.

The forming roll may be evacuated or not evacuated. In both cases, this achieves particularly high initial dewatering in the region of the forming roll. As a result, the second fiber ply can be led along a short path to the combining section. This also produces a particularly compact construction.

An embodiment is advantageous in which the second fiber ply, which is initially dewatered on the forming roll, can be led to the couch roll on a direct path, without deflection around a further roll. This permits particularly high operating speeds to be achieved. It is particularly beneficial to arrange the forming roll underneath the "gap", i.e., the entry pocket of the wires into the twin-wire zone. In this case, the forming roll may preferably not be evacuated but is nevertheless provided with an open surface, for the temporary storage of water. As a result, the second fiber ply is dewatered with less damage on the forming roll side so that fines are kept in this side of the paper ply. Since it is only this side of the second fiber ply that contacts the first fiber ply, the bonding of the fiber plies is improved.

In this case, providing a dewatering arrangement between the forming roll and the couch roll is particularly preferred. That arrangement has a box, preferably a suction box that is assigned to the first wire, designated as a top wire. The suction box includes stationary forming foils which are located in the loop of and engage the first wire and which generate pressure pulses in the suspension. Forming foils may also contact the second wire designated as a bottom wire. The foils of the first wire form a convexly curved running surface which deflects the second wire through an angle in the range of 0° to 20°. The foils above and below are arranged to alternate in the wire running direction. The forming foils can be designed to be movable or to be rigid.

This type of dewatering arrangement is also known as a D part. Connecting such a D part downstream of a forming roll that produces the initial dewatering causes ideal web formation. The formation of flocs is largely prevented. The result is shear forces acting uniformly over the web thickness. In this case, it is of particular advantage if the stationary forming foils form a concavely curved running surface by means of which the top wire is deflected through an angle in the range from 0° to 20°.

This means retains both wires securely in contact with the second fiber ply being formed which produces more uniform dewatering in the region of the dewatering arrangement, i.e., the D part. Deflection at an angle in the range from 0° to 20° is, on the other hand, still acceptable in this case from the point of view of maximum speed.

According to a further preferred embodiment, the first wire is designed as a top wire and wraps around the forming roll, while the first and the second wires together wrap around a deflection roll between the forming roll and the combining section. This variant is particularly advantageous when an especially thick and therefore initially high water content second fiber ply and/or an especially difficult to dewater second fiber ply is intended to be formed. The achievable speeds are not quite as high as in the previous embodiment which is without a deflection roll between the forming roll and the combining section. Alternatively, the deflection roll can be designed as an evacuated or a non-evacuated forming roll.

In an embodiment wherein the second wire has a series of forming foils applied against it, the foils are arranged opposite a region of the forming roll which is wrapped around by the top wire and the bottom wire. This improves formation on that side of the second fiber ply, which is joined to the first fiber ply in the combining section. The forming foils can be designed both as rigid foils and also as movable forming foils.

A suction separator is assigned to the first wire upstream of the couch roll. The suction separator enables the bottom wire to be separated from the second fiber ply at high running speed, before the second fiber ply is carried on the top wire to the combining section.

Of course, the present invention can be used for producing two-ply fiber webs and also three-ply or multi-ply fiber webs.

Further, the features described above and features explained below can be used not only in the combinations specified but also in other combinations or on their own, within the scope of the invention.

Other features and advantages of the present invention will become apparent from the following description of the invention which refers to the accompanying drawings.

DETAILED DESCRIPTION OF THE INVENTION

Figure 1:
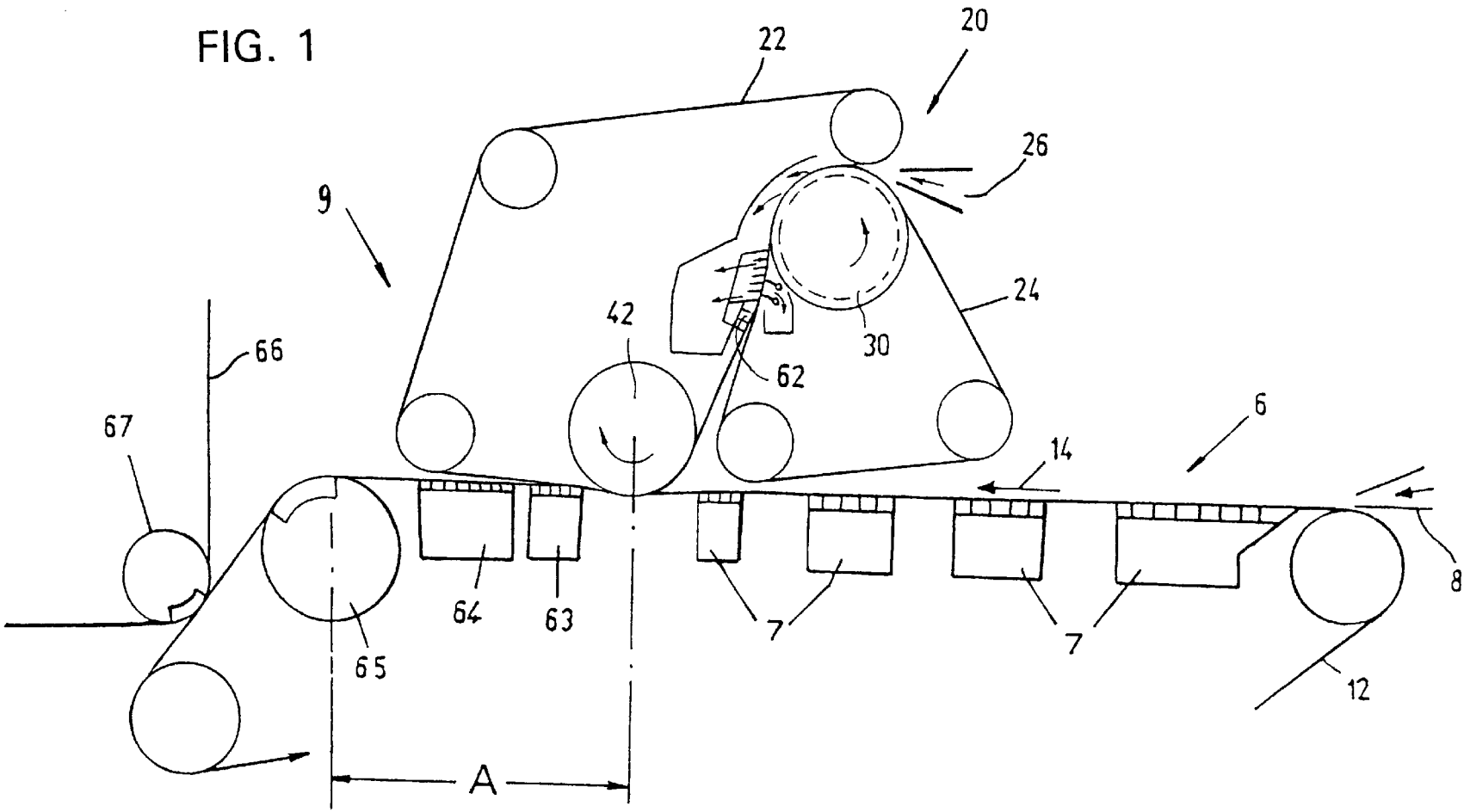
FIG. 1 schematically shows a wire section for producing a multi-ply fiber web, including a twin-wire part placed on a Fourdrinier unit.

FIG. 1 shows a first embodiment of a wire section 9 according to the invention, which is used for forming multi-ply fiber webs, in particular paper or board webs. The wire section 9 is therefore predominantly intended for papermaking machines.

The wire section comprises a Fourdrinier unit 6, having an approximately horizontally guided belt (preferably a web or a felt) 12, with a running direction shown by an arrow 14. On the belt 12, a first fiber ply (not illustrated) is formed by a headbox or flowbox 8 followed by a plurality of dewatering elements 7. As explained below, the first fiber ply is combined with a second fiber ply to form a two-ply fiber web.

Figure 2:
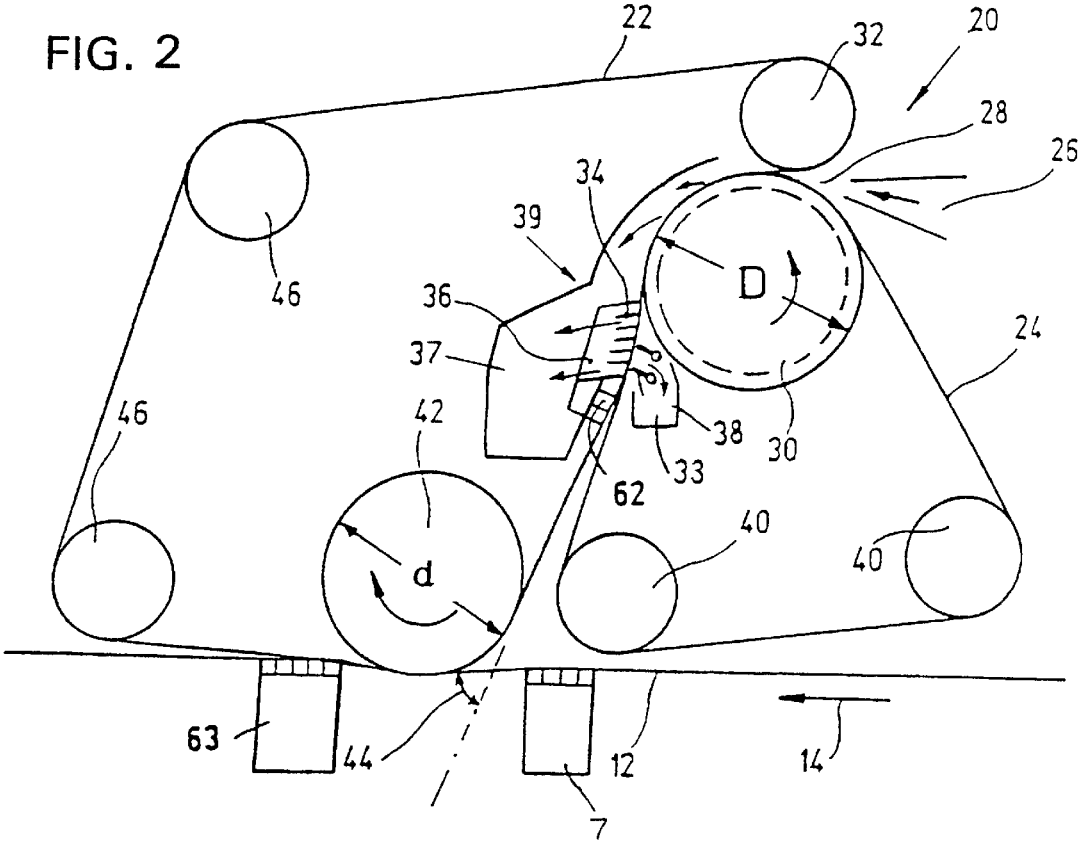
FIG. 2 shows a schematic side view of a first embodiment of a twin-wire part according to the invention.

A twin-wire part 20, shown enlarged in FIG. 2, is arranged above the belt 12 and forms the second fiber web or ply. The twin-wire part 20 has a first endless loop belt or wire 22 and a second endless loop belt or wire 24, which are guided to move parallel through a twin-wire zone in order to form the second fiber ply. In the region of the beginning of the twin-wire zone, the two wires 22, 24 form an entry gap 28. A headbox 26 indicated schematically at the entry gap 28 injects a fibrous suspension for the second fiber ply into the entry gap 28. Alternatively, a multi-layer headbox can also be provided. This type of arrangement causes the twin-wire part 20 to be a so-called "gap former".

A forming roll 30 is provided in the region of the entry gap 28 and in the loop of the second wire 24, which is a bottom wire. A wire guide roll 32 is provided in the loop of the first wire 22, which is a top wire.

The forming roll 30 has an open roll cover, i.e., it is provided with cutouts, and it is preferably not an evacuated roll. Alternatively, the forming roll 30 may be evacuated. The wires 22, 24 run together over an upper section of the forming roll 30 and between the roll 30 and the opposite wire guide roll 32. The wires wrap around the forming roll 30 over an angle which is preferably smaller than 90°.

Directly adjoining the forming roll 30 is a web dewatering section 39 in the form of a so-called D part. In the region of the top wire 22, the D-part includes an either evacuated or non-evacuated suction box 36 which supports a series of stationary forming foils or strips 34 which are oriented so that their free ends contact and press against the top wire. The suction box 36 is combined with a suction separator. The first stationary foil 34 of the suction box 36 is arranged directly in the outlet region of the forming roll 30. The forming foils 34 of the box 36 together form a running surface that is slightly convexly curved in the running direction of the wires 22, 24. On the side of the bottom wire 24, opposite the foils 34 of the box 36, a number of movable, preferably pneumatically loaded foils or strips or ledges 33 may be arranged. The movable foils or strips 33 have free ends or edges that are oriented to press against the bottom wire 24. The stationary foils 34 and the movable foils 33 of the forming board 38 are arranged to alternate along the wire running direction.

There are water receiving containers 37 and 31, respectively, associated with the foils 34 and 33.

In the outlet region of the D part 39, the bottom wire 24 is separated from the second fiber ply by a suction separator 62. The bottom wire is led back to the forming roll 30 over a plurality of guide rolls 40.

The top wire 22 with the formed second fiber ply carried on it is led directly from the outlet region of the D part to a couch roll 42. The diameter d of the couch roll 42 is relatively large, e.g. as large as or only slightly smaller than the diameter D of the forming roll 30. The couch roll 42 is arranged such that the couch roll 42 dips into the belt, or such that the roll is slightly wrapped around by the belt 12.

The top wire 22 carrying the second fiber ply runs from the D part 39, oriented at an angle 44 of less than 90°, preferably in the range of 70° to 80°, and shown herein at about 75° with respect to the orientation of the belt there the belt 12 and onto the couch roll 42. The first and the second fiber webs are couched together between the top wire 22 and the belt 12 by means of the couch roll 42. The top wire 22 is separated from the multi-ply fiber web in the outlet region of the couch roll 42. The multi-ply fiber web that is combined in this way to consist of the first and the second fiber plies is separated from the top wire 22 by a further suction separator 63 and thereafter runs further together with the belt 12, for example over a suction box 64 and a wire suction roll 65 (FIG. 1). The web is thereafter removed from the belt 12 in a known way, by a felt belt 66 and a pickup roll 67, and is fed to a following unit of the machine, e.g. a press section. The top wire 22 is led back to the wire guide roll 32 located opposite the forming roll 30 by wrapping over wire guide rolls 46.

Thus, for the purpose of initial dewatering, the twin-wire part 20 has a forming roll 30 followed by a so-called D part 39 for further dewatering. The twin-wire part 20 is therefore a so-called "roll-blade former".

In this embodiment, the twin-wire part 20 is arranged upstream of the couch roll 42 along the running direction 14 of the belt 12. Arrangement upstream of the couch roll 42 means that the forming or wire section from the headbox 26 and including the last forming unit (D part 39) is arranged upstream of the couch roll 42. That the wire guide rolls 46 for return travel of the empty top wire 22 are to some extent placed downstream of the couch roll 42 as viewed on the path of the belt 12, as shown in FIG. 2, is intended to be irrelevant in the present context.

This arrangement causes the two wires 22, 24 of the twin-wire part 20 and the belt 12 to have substantially the same running direction. Therefore, the second fiber ply in the twin-wire former 20 is deflected only slightly before being couched. This enables extraordinarily high speeds of the entire wire section 9 to be achieved.

This arrangement of the forming roll 30 and the downstream D part 39 in the twin-wire part 20 produces a side of the second fiber ply that is richer in fines on the side facing away from the top wire 22, and that is the side of the second ply that is couched together with the top side of the first fiber ply.

Other arrangements of forming foils are also possible instead of the D part 39. For example, a suction box may also be provided on the bottom wire. Also, the forming roll 30 could also be evacuated. However, it has been found that extraordinarily high speeds with an excellent quality of the multi-ply fiber web formed can be achieved as a result of the combination of a non-evacuated open forming roll 30 with a D part 39.

Figure 3:
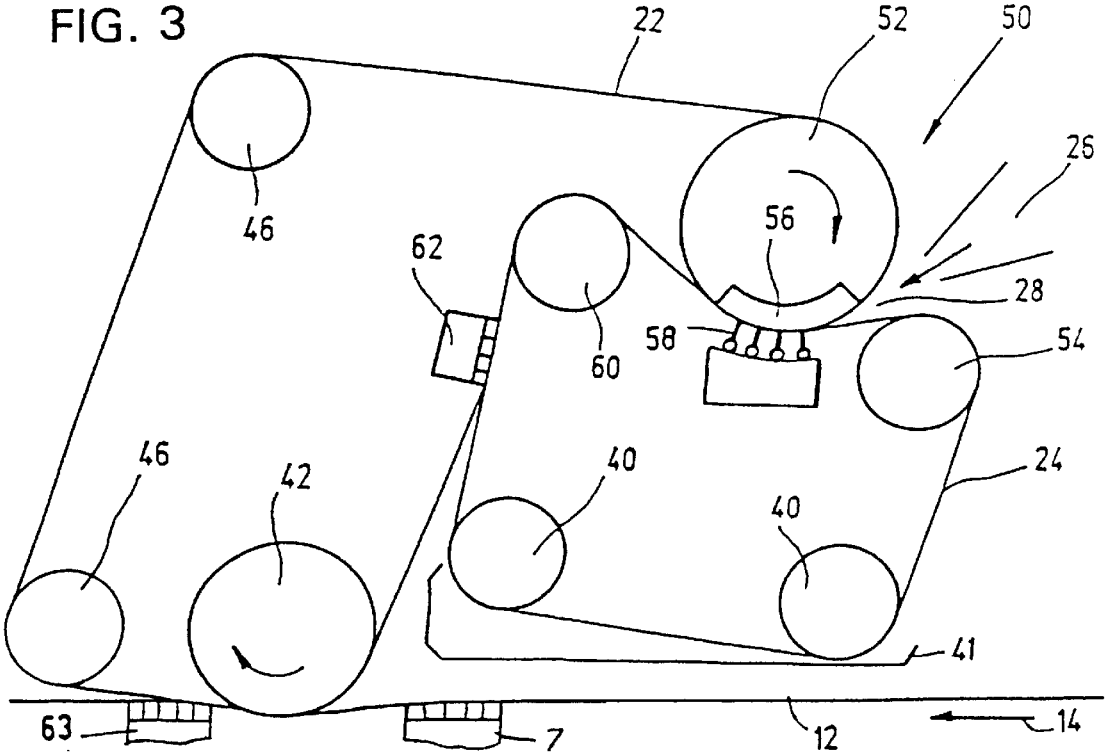
FIG. 3 shows a schematic side view of a second embodiment of a twin-wire part according to the invention.

FIG. 3 illustrates a second embodiment 50 of a twin-wire part according to the invention. The same reference numbers are used for elements which have the same function as corresponding elements of the twin-wire part 20.

The twin-wire part 50 again has an approximately horizontally aligned belt 12, on which a first, preformed fiber ply leads to the twin-wire part 50 in the direction 14.

The twin-wire part 50 has a top wire 22 and a bottom wire 24. The twin-wire part 50 has a forming roll 52, which is wrapped around by the top wire 22. A wire guide roll 54 is provided on the bottom wire 24 in the region of the entry gap 28 and the bottom wire 24 runs from the wire guide roll 54 onto the forming roll 52. The forming roll 52 has an arcuate suction section 56, which is arranged approximately in the region over which the top wire 22 and the bottom wire 24 together wrap around the forming roll 52. A series of forming foils 58 are provided on the bottom wire 24 opposite the forming roll 52 and their free ends press on the wire 24. These foils 58 are movable. Each foil 58 is pneumatically pressed, i.e., compliantly, against the bottom wire 24 with an individually adjustable force.

The top wire 22 and the bottom wire 24, together with the second fiber ply that is arranged between them but is not illustrated, run obliquely upward from the forming roll 52 and wrap around a deflection roll 60. From the deflection roll 60, the top wire 22, with the second fiber web ply lying upon it, runs to the couch roll 42. In order to lift the second ply off the bottom wire 24, a suction separator 62 is arranged on the side of the top wire, just downstream of the outlet region of the deflection roll 60. The web is carried on the underside of the upper wire 22. From the suction separator 62, the top wire 22, together with the fiber ply lying upon it, runs onto the couch roll 42 at an angle 44 of about 75° in relation to the orientation of the belt 12 as the belt enters and passes by the combining section at the couch roll 42. At the belt 12, the first fiber ply on the belt 12 meets the second fiber ply on the wire 22. A catching container 41 is located underneath the bottom wire for receiving spray water. One of these containers may also be provided in the embodiment of FIG. 2.

The twin-wire part 50 differs from the twin-wire part 20 illustrated in FIG. 2, first by the arrangement of the forming elements, i.e., forming roll 52 and forming foils 58, and secondly by the deflection roll 60, which is provided between the forming roll 52 and the couch roll 42. The deflection roll 60 can either be an evacuated or a non-evacuated forming roll.

In this embodiment also, the second fiber ply is deflected only slightly before running into the couch roll 42. This is because, in contrast with the twin-wire part 20, the forming roll 52 of the twin-wire part 50 is wrapped around by the wires 22, 24 only over a relatively small angular section of about 45°, whereas the forming roll 30 of the twin-wire part 20 is wrapped around by the wires 22, 24 over an angle of about 90°.

The twin-wire parts 20 and 50 have in common that their twin-wire zones are both arranged upstream of the couch roll 42 in the running direction 14 of the belt 12. As a result, the second fiber ply must be deflected only slightly, proceeding from the headbox 26 as far as the couch roll 42. This applies especially as the running direction 14 of the belt 12 and that of the wires 22, 24 in their forming region, i.e., their twin-wire zones, are substantially identical. In other words, the outflow directions of the two headboxes 8 and 26 in FIG. 1 are at least approximately identical. This means, coupled with the compact construction of the twin-wire part, enables the distance A between the couch roll 42 and the wire suction roll 65 to be made smaller than previously. This means that a small overall length of the wire part 9 can be achieved.

The slight deflection of the second fiber ply in the twin-wire parts 20 and 50 enables very high operating speeds to be achieved with the wire sections 9 according to the invention, without a risk of the web lifting off. At the same high speed, the lower deflection allows higher moisture contents directly upstream of the couching stage, which achieves an improved ply bond strength. Since both twin-wire parts 20, 50 are upstream of the couch roll 42 in the running direction 14 of the belt 12, the jointly couched multi-ply fiber layer following the couch roll 42 is not influenced by the operation of the twin-wire part 20, 50. In particular, condensate droplets do not drop from the twin-wire part 20, 50 onto the finished multi-ply fiber layer. In any case, such droplets would impinge on the preformed first fiber ply. But, this would not significantly impair the web formation.

The twin-wire parts 20, 50 are preferably used for forming a white liner on the first fiber ply or for increasing the basis weight.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A wire section for forming a multi-ply fiber web, the wire section comprising:

a belt on which a first fiber ply is formed;

a twin-wire part including a first wire section wire and a second wire section wire defining a gap former;

a forming roll at which the first and second wires define a gap for receiving fiber suspension at the beginning of the gap former; the first and second wires transporting the fiber suspension to the forming roll without actively dewatering the fiber suspension then wrapping over and advancing past the forming roll;

first guide elements for causing the first and second wires to run together for supporting a layer of fiber suspension between the first and second wires and forming a second fiber ply;

a combining section for combining the first and second plies wherein the belt has a first orientation at the combining section and wherein the second ply is above the first ply and for forming the multi-ply fiber web in the combining section;

the twin-wire part being upstream of the combining section with respect to a running direction of the first belt;

after the first and second wires run together to form the second fiber ply, the first and second wires being supported to separate so that the second fiber ply continues supported on the first wire and the first wire with the second ply entering the combining section; second guide elements supporting the first wire as it enters the combining section to orient the first wire at an angle with respect to the first orientation of the first belt entering the combining section; and third guide elements for guiding the second wire so as to not enter the combining section.

2. The wire section of claim 1, wherein the belt is guided to advance in a first direction and to have the first orientation in the combining section; the first and second wires are guided by the first guide elements to advance in a second direction which is different than the first direction and the first orientation; and the first and second directions aim toward the combining section.

3. The wire section of claim 2, wherein the gap former has a beginning oriented so that an inflow direction of the fiber suspension for forming the second fiber ply is substantially identical to the first direction of the belt.

4. The wire section of claim 2, wherein the angle at which the first wire enters the combining section with respect to the first orientation of the belt is in the range of 60° to 80°.

5. In combination, the wire section of claim 4, with a headbox having an outlet oriented for supplying suspension to the beginning of the gap former and between the first and second wires in an inflow direction which is substantially equal to the running direction of the belt.

6. The wire section of claim 2, wherein the combining section comprises a couch roll.

7. The wire section of claim 6, wherein the couch roll has a diameter approximately equal to the diameter of the forming roll.

8. The wire section of claim 2, wherein the first wire is an endless first loop and the first guide elements guide the first wire in the first loop;

a suction separator in the loop of the first wire along the path where the first and second wires are moving in the second direction, the suction separator for separating the second wire from the second fiber ply and from the first wire, whereby the second fiber ply continues to travel on the separated first wire.

9. The wire section of claim 2, wherein the first wire is an endless first loop and the first guide elements guide the first wire in the first loop; the forming roll being in the first loop of the first wire.

10. The wire section of claim 2, wherein the combining section comprises a couch roll;

the first wire defining a first loop, being guided by the couch roll located in the first loop.

11. The wire section of claim 10, wherein the first wire is a top wire and the second wire is a bottom wire.

12. The wire section of claim 11, wherein the second wire is an endless second loop and the first guide elements guide the second wire in the endless second loop;

the second wire being so shaped and guided by the first guide elements that the forming roll is located in the endless second loop.

13. The wire section of claim 12, wherein the path in the second direction between the forming roll and the couch roll is free of any further rolls touching the first wire.

14. The wire section of claim 12, further comprising a dewatering arrangement in the first loop between the forming roll and the couch roll.

15. The wire section of claim 14, wherein the dewatering arrangement comprises stationary forming foils having edges which contact the first wire for pressing thereupon.

16. The wire section of claim 15, wherein the forming foils are so positioned that their ends contacting the first wire define a convexly curved running surface shaped so that the second wire is deflected through an angle in the range of 0° and 20°.

17. The wire section of claim 15, further comprising a suction box associated with the forming foils for assisting in the dewatering of the suspension passing on the wires past the foils.

18. The wire section of claim 15, further comprising second forming foils in the second loop of the second wire and having edges supported for compliant pressing against the second wire and opposed to the stationary foils against the first wire.

19. The wire section of claim 18, wherein the stationary foils against the first wire and the second foils against the second wire are arranged to alternate in the second direction.

20. The wire section of claim 12, further comprising a deflection roll along the path of the first and second wires between the forming roll and the couch roll and the first and second wires jointly wrapping around the deflection roll.

21. The wire section of claim 20, further comprising a plurality of foils arrayed along the path of the wires passing the forming roll, the foils having edges which are supported to be compliantly pressed toward the forming roll and against the wires passing the forming roll.

22. The wire section of claim 2, further comprising a suction box at the first wire for aiding in the dewatering at the first wire.

23. The wire section of claim 22, further comprising forming foils positioned at the suction box at the side of the first wire for applying pressure on the first wire.

24. The wire section of claim 23, further comprising further forming foils at the second wire for applying pressure on the second wire.

25. The wire section of claim 24, further comprising a dewatering arrangement disposed on the path of the first wire and the second fiber ply before the combining section.

26. The wire section of claim 2, wherein the angle at which the first wire enters the combining section with respect to the belt is less than 90°.

* * * * *